US005762076A

United States Patent [19]

Chan et al.

[11] Patent Number: 5,762,076

[45] Date of Patent: Jun. 9, 1998

[54] WIRE CLIP FOR BARRETTE

[76] Inventors: Richard M. Chan; Wende D. Chan, both of 2562 - 47th Ave., San Francisco, Calif. 94116

[21] Appl. No.: 748,046

[22] Filed: Nov. 12, 1996

Related U.S. Application Data

[63] Continuation-in-part of Ser. No. 452,964, May 30, 1995, abandoned.

[51] Int. Cl.[6] ..... A45D 8/22; A45D 8/28

[52] U.S. Cl. ..... 132/278; 132/276; 132/279; 24/518

[58] Field of Search ..... 132/278, 273, 132/277, 275, 276, 279; 24/518, 505, 499, 67.3, 67.11

[56] References Cited

U.S. PATENT DOCUMENTS

| | | | |
|---|---|---|---|
| 895,706 | 8/1908 | Winey | 24/499 |
| 1,373,988 | 4/1921 | Wallick | 24/67.11 |
| 1,531,035 | 3/1925 | Sereny | 132/276 |
| 1,778,428 | 10/1930 | Morehouse | 132/276 |
| 1,921,889 | 8/1933 | Shelton | 24/67.11 |
| 4,753,252 | 6/1988 | Boxer | 132/275 |

*Primary Examiner*—John J. Wilson
*Assistant Examiner*—Pedro Philogene
*Attorney, Agent, or Firm*—William S. Bernheim

[57] ABSTRACT

A barrette for holding hair having an improved wireform latch in which the barrette includes a top plate having upstanding pivots and upstanding receptor hooks, and the wireform being a semirigid wire in a frogleg shape which is put in tension parallel to the plate by compressing the legs together to allow hooking of the legs to the pivots and in rotary tension away from the plate by compressing hair between the plate and wireform by such hooking.

4 Claims, 2 Drawing Sheets

WIRE CLIP FOR BARRETTE

CROSS REFERENCES TO RELATED APPLICATIONS

The application is a continuation-in-part of application, Wireform Mechanism for Barrettes and Hairclips, filed May 30, 1995 as Ser. No. 08/452,964 now abandoned.

BACKGROUND OF THE INVENTION

1. Field of the Invention

This invention relates to an improved clasping mechanism for barrettes.

2. Description of the Prior Art

There are many kinds of clasping mechanisms for barrettes. These include various stamped sheet metal components with appendages for hinging and locking. Drawbacks include manufacturing difficulty and lack of durability.

Examples are seen in U.S. Pat. No. 5,259,405 to Hua-Chou; U.S. Pat. No. 5,109,878 to Kuo-Hua; U.S. Pat. No. 4,976,277 to Yasuda; and U.S. Pat. No. 4,919,155 to Yasuda. They share in common stamped sheet metal parts including a top plate to which an ornamental piece may be fixed, and to which a lower retaining plate is rotatively attached at one end and at the opposite end releasably attachable to the top plate. A curved spring is typically affixed at both ends to either the top plate to curve toward the lower plate or the lower plate to curve toward the top plate. For wearing, hair is placed between the top plate and open lower plate of the barrette and the lower plate rotated to close and attached at its opposite end to the top plate to enclose and hold the hair. It is intended for the closing to compress the curved spring sufficiently for friction to hold the barrette in place.

Additional drawbacks include the depth of the barrette which pushes the barrette off the scalp, inability to accommodate the multitude of hair types, and damage caused to hair by the holding mechanism. Exmples of holding mechanisms include U.S. Pat. No. 5,109,878 to Kuo-Hua; U.S. Pat. No. 3,590,830 to E. Hannum; and U.S. Pat. No. 4,753,252 to L. Bower.

The complex holding mechanisms frequently fail due to deformation such as flattening and twisting or due to breakage. The L. Bower barrette for example is complicated to manufacture. The mechanism is not curved in the longitudinal direction, the ends project outward and awkwardly away from the hair line thus difficult to wear. The relative bulkiness adds unnecessary weight to the barrette which necessitates the adding of the rows of grooves and slots to offset gravity. In turn, the grooves and slots increase the likely pain due to pulled hairs and damage to the hair due to hair breakage.

OBJECTS OF THE INVENTION

Accordingly, it is an object of this invention to provide an improved holding mechanism for barrettes.

Another object is a light weight basic barrette.

Yet another object is a durable holding mechanism resistant to flattening, twisting and breakage.

a further object that the light weight basic barrette be an ornamental piece can be added to the top plate.

Other objectives, advantages and novel features of the invention will become apparent to those skilled in the art upon examination of the invention and the accompanying drawings.

SUMMARY OF THE INVENTION

BRIEF DESCRIPTION OF THE FIGURES

The following detailed description, taken in conjunction with the accompanying drawings, illustrates a preferred embodiment of the invention. The drawings are.

REFERENCE NUMERALS

10 Wire form
12 Top plate
14M Upstanding pivot
14N Upstanding pivot
16O Upstanding receptor hook
16P Upstanding receptor hook
18O Opposing tab
18P Opposing tab

Detailed Description of a Preferred Embodiment

Figure 1:
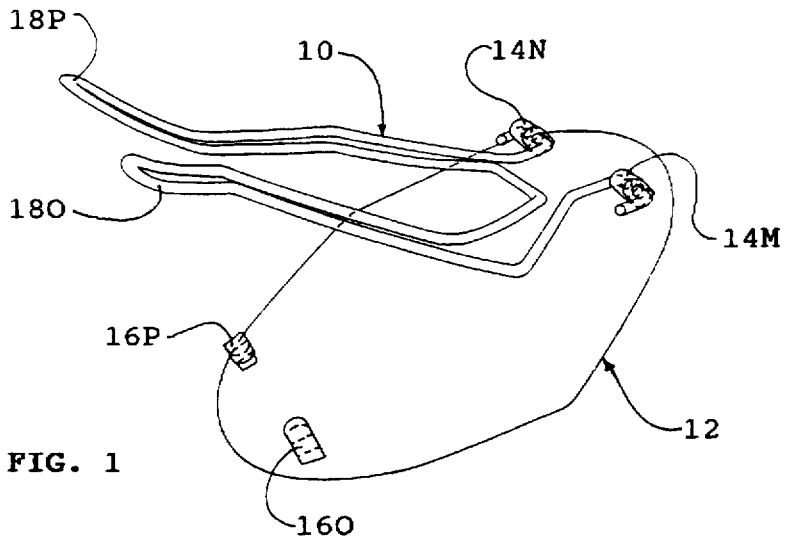
FIG. 1 is a perspective view of the inventive barrette.
Figure 2:
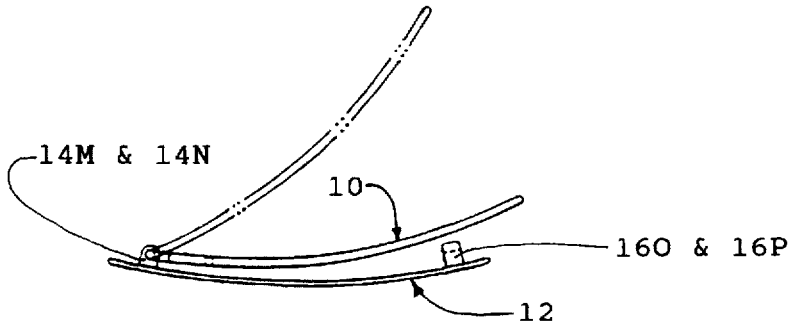
FIG. 2 is a side view of the invention in an open position.
Figure 3:
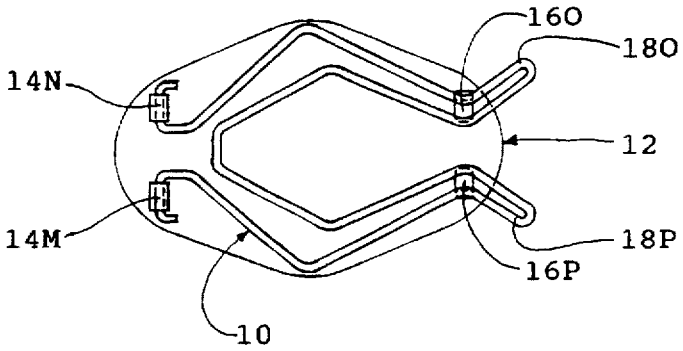
FIG. 3 is a plan view of the invention in an open position.
Figure 4:
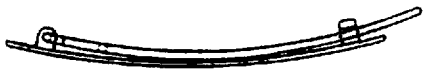
FIG. 4 is a side view of the invention in the closed position.
Figure 5:
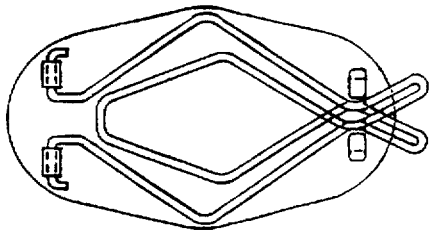
FIG. 5 is a plan view of the invention in the insertion position.
Figure 6:
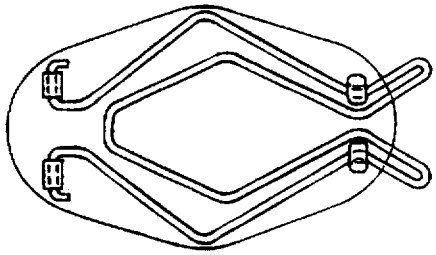
FIG. 6 is a plan view of the invention in the closed position.

As shown in FIG. 1, the barrette includes an improved wireform 10 attached to a top plate 12 by means of upstanding pivots 14M and 14N which are glued or welded to the top plate and provide tubes through opposite ends of the wireform 10 passed and secured by bending the wire 90° or by another method. By passing the ends through the tubes the wireform 10 can rotate about 180° about the upstanding pivots 14M and 14N. There are a multitude of attachment means allowing the needed rotation. Rotation of through only about 45° is needed from the closed position to allow utilization of the barrette.

The top plate 12 is typically a single piece of stamped sheet metal of sufficient strength not to bend or twist without intent. The plate 12 can itself be decorative or serve as a base to which an ornamental piece can be attached by various means including gluing. The plate 12 can have cutouts for decoration or weight reduction or provide a pair of opposing hooks 18O and 18P for securing. Preferably, the plate 12 is curved slightly to somewhat match the curvature of the expected barrette wearer. Typically the plate 12 is longer, the direction in which the wireform 10 rotates, than wide. As mentioned previously the plate 12 includes upstanding pivots 14M and 14N on one side. On this same side are the opposing hooks 18O and 18P. The hooks can be formed by a cutout or by gluing or welding a piece of metal or plastic to the plate 12. The hooks 18O and 18P each have an opening which face the opening of the other hook.

The wireform 10 is inventive. The wireform 10 is shaped from semirigid wire and is frogleg shaped. The wireform 10 includes a first outward run, a first inward run shorter than the first outward run, a short cross run, a second inward run, substantially a mirror image of the first inward run, and a second outward run, substantially a mirror image of the first outward run. Each inward and outward run includes at least 2 bends. Each of these bends lies in a plane substantially perpendicular to direction of rotation of the wireform 10 and is at an obtuse angle. The wireform 10 is continuous with each outward run joined to an inward run by a U-shaped portion 18O and 18P reversing the direction of the wire about 180°. The cross runs join and form an almost 90° angle with each of the inward runs.

Preferably the wireform 10 overall is slightly curved to match plate 12 if curved. The radius of curvature of the wireform is typically a little less than that of the plate 12 which allows for less spacing which increases the hair gripping potential.

In operation the U-shaped portions 18O and 18P serve as opposing tabs which can be compressed for insertion between or removed from the receptor hooks 16O and 16P. The wireform 10 is designed to act as a spring with respect to the receptor hooks, when hooked in compression and to act as a spring with respect to hair of sufficient volume if hair is placed between the wireform 10 and plate 12.

We claim:

1. A barrette comprising a plate having upstanding pivots and upstanding receptor hooks and a wireform formed of a semirigid wire in a frogleg shape including a first outward run, a first inward run shorter than the first outward run, a short cross run, a second inward run substantially a mirror image of the first inward run and a second outward run substantially a mirror image of the first outward run.

2. The barrette of claim 1 wherein each inward and outward run includes at least two (2) bends.

3. The barrette of claim 2 wherein the wireform includes means for being rotatably mounted to the pivots and each of such bends of such inward and outward run are in a plane substantially perpendicular to direction of rotation of the wireform and the angle of such bends is (at) an obtuse angle.

4. The barrette of claim 1 includes two (2) U-shaped portions which reverse the direction of the wire about 180°.

* * * * *